US010953521B2

(12) United States Patent
Zimmermann et al.

(10) Patent No.: US 10,953,521 B2
(45) Date of Patent: Mar. 23, 2021

(54) DRIVER

(71) Applicant: MILWAUKEE ELECTRIC TOOL CORPORATION, Brookfield, WI (US)

(72) Inventors: Michael J. Zimmermann, New Berlin, WI (US); Smith C. Theiler, Plymouth, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 276 days.

(21) Appl. No.: 15/981,105

(22) Filed: May 16, 2018

(65) Prior Publication Data

US 2018/0333829 A1 Nov. 22, 2018

Related U.S. Application Data

(60) Provisional application No. 62/506,719, filed on May 16, 2017.

(51) Int. Cl.

| | |
|---|---|
| ***B25B 13/10*** | (2006.01) |
| ***B25B 23/00*** | (2006.01) |
| ***B25B 13/06*** | (2006.01) |
| *B25B 21/00* | (2006.01) |

(52) U.S. Cl.

CPC ..... *B25B 13/102* (2013.01); *B25B 13/065* (2013.01); *B25B 23/0035* (2013.01); *B25B 21/00* (2013.01)

(58) Field of Classification Search

None

See application file for complete search history.

(56) References Cited

U.S. PATENT DOCUMENTS

| | | | | |
|---|---|---|---|---|
| 1,422,067 | A | 7/1922 | Abegg | |
| 3,233,482 | A | 2/1966 | Jaehne | |
| 3,285,106 | A * | 11/1966 | Svenson | B25B 13/102 81/185 |
| 4,982,627 | A | 1/1991 | Johnson | |
| D335,071 | S | 4/1993 | Fine | |
| D365,113 | S | 12/1995 | Ronan | |
| 5,485,769 | A | 1/1996 | Olson et al. | |
| D379,420 | S | 5/1997 | Standlee et al. | |

(Continued)

FOREIGN PATENT DOCUMENTS

| | | |
|---|---|---|
| BE | 538154 | 5/1955 |
| CH | 289452 | 3/1953 |

(Continued)

*Primary Examiner* — Brian D Keller

(74) *Attorney, Agent, or Firm* — Michael Best & Friedrich LLP

(57) ABSTRACT

An accessory driver tool connectable to a power tool includes a main body and a sleeve. The main body includes a first end, a second end, a tool coupling mechanism at the first end, and a first fastener driving member disposed at the second end. The sleeve, disposed concentrically about the main body, includes a second fastener driving member disposed adjacent the second end of the main body. The sleeve is axially displaceable along the main body between a retracted position, in which the first fastener driving member is exposed to engage a first fastener, and an extended position, in which the second fastener driving member is exposed to engage a second fastener. The sleeve is rotatable relative to the main body while in the extended position.

20 Claims, 12 Drawing Sheets

(56) References Cited

U.S. PATENT DOCUMENTS

| | | | |
|---|---|---|---|
| D414,391 | S | 9/1999 | Stagmo |
| D484,376 | S | 12/2003 | Cromer |
| D493,081 | S | 7/2004 | Chen |
| 6,761,093 | B2 | 7/2004 | Chang |
| D500,435 | S | 1/2005 | Dexter et al. |
| D500,944 | S | 1/2005 | Dexter et al. |
| D501,769 | S | 2/2005 | Harrison-Griffin |
| D523,305 | S | 6/2006 | Dexter et al. |
| D525,839 | S | 8/2006 | Raukman |
| D539,131 | S | 3/2007 | Hsien |
| 7,281,310 | B2 | 10/2007 | Moore et al. |
| D564,847 | S | 3/2008 | Hurlburt |
| 7,448,121 | B1 | 11/2008 | Hung |
| D584,118 | S | 1/2009 | Halstead |
| D589,319 | S | 3/2009 | Peters et al. |
| D629,025 | S | 12/2010 | Greenleaf |
| D642,882 | S | 8/2011 | Lane |
| D659,730 | S | 5/2012 | Cantlon |
| D709,744 | S | 7/2014 | Kluhsman, Jr. |
| 8,960,055 | B2 | 2/2015 | Lin |
| D732,579 | S | 6/2015 | Kim et al. |
| D736,053 | S | 8/2015 | Zhang |
| 9,144,893 | B2 | 9/2015 | Su |
| 9,156,147 | B2 | 10/2015 | Peters et al. |
| 9,283,661 | B2 | 3/2016 | Cummings et al. |
| 9,616,553 | B2 | 4/2017 | Marovets |
| D853,808 | S | 7/2019 | Hyma et al. |
| 2004/0216566 | A1 | 11/2004 | Shih |
| 2005/0193874 | A1 | 9/2005 | Shih |
| 2007/0131065 | A1 | 6/2007 | Shih |
| 2008/0041193 | A1 | 2/2008 | Baker |
| 2008/0047400 | A1 | 2/2008 | Hu |
| 2009/0008886 | A1 | 1/2009 | Shu |
| 2012/0137837 | A1 | 6/2012 | Souma |
| 2015/0151412 | A1* | 6/2015 | Chen ..... B25B 23/0035 81/124.5 |
| 2016/0263730 | A1 | 9/2016 | Cummings et al. |

FOREIGN PATENT DOCUMENTS

| | | |
|---|---|---|
| CN | 2036083 | 7/1989 |
| CN | 2712553 | 7/2005 |
| CN | 102672646 | 9/2012 |
| DE | 136231 | 4/1902 |
| DE | 593905 | 3/1934 |
| FR | 2631275 | 11/1989 |
| GB | 191515781 | 7/1916 |
| GB | 2193136 | 2/1988 |
| JP | S5152395 | 4/1976 |
| JP | S52132395 | 10/1977 |
| JP | S53143197 | 11/1978 |
| JP | H02145967 | 12/1990 |
| JP | H1170479 | 3/1999 |
| JP | 2004025343 | 1/2004 |
| JP | 4172940 | 10/2008 |
| JP | 2009107058 | 5/2009 |
| JP | 2009255261 | 11/2009 |
| JP | 5178141 | 4/2013 |
| WO | 2009093624 | 7/2009 |

* cited by examiner

DRIVER

REFERENCE TO RELATED APPLICATION

This application claims the benefit of prior-filed, U.S. Provisional Patent Application No. 62/506,719, filed May 16, 2017, the entire contents of which are hereby incorporated by reference.

BACKGROUND

The present disclosure relates to the field of drivers and particularly accessory driver tools connectable to power tools.

SUMMARY

The present invention provides, in one aspect, an accessory driver tool connectable to a power tool. The accessory driver tool includes a main body and a sleeve. The main body includes a first end, a second end, a tool coupling mechanism at the first end, and a first fastener driving member disposed at the second end. The sleeve, disposed concentrically about the main body, includes a second fastener driving member disposed adjacent the second end of the main body. The sleeve is axially displaceable along the main body between a retracted position, in which the first fastener driving member is exposed to engage a first fastener, and an extended position, in which the second fastener driving member is exposed to engage a second fastener. The sleeve is rotatable relative to the main body while in the extended position.

The present invention provides, in another aspect, a method for operating an accessory driver tool. The accessory tool includes a main body having a first end, a second end, and a tool coupling mechanism at the first end and a first fastener driving member disposed at the second end. The accessory tool also includes a sleeve disposed concentrically about the main body. The sleeve has a second fastener driving member disposed adjacent the second end. The method includes engaging a first fastener with the first fastener driving member of the main body while the sleeve is in a retracted position relative to the main body. The method also includes axially displacing the sleeve along the main body from the retracted position to an extended position. The method further includes rotating the sleeve relative to the main body while in the extended position to secure the sleeve in the extended position. The method also includes engaging a second fastener with the second fastener driving member of the sleeve while the sleeve is in the extended position relative to the main body.

The present invention provides, in a further aspect, an accessory driver tool connectable to a power tool. The accessory driver tool includes a main body and a sleeve. The main body includes a first end, a second end, a tool coupling mechanism at the first end, and a first fastener driving member disposed at the second end. The second end of the main body defines an end surface. The sleeve, disposed concentrically about the main body, includes a second fastener driving member disposed adjacent the second end of the main body and a locking feature formed on an inner surface of the sleeve. The accessory driver tool also includes a spring coupled between the sleeve and the main body to bias the sleeve toward a retracted position, in which the first fastener driving member is exposed to engage a first fastener. The sleeve is axially displaceable along the main body against a bias of the spring to an extended position, in which the second fastener driving member is exposed to engage a first fastener. The locking feature of the sleeve engages the end surface of the main body to secure the sleeve in the extended position against the bias of the spring.

Other features and aspects of the invention will become apparent by consideration of the following detailed description and accompanying drawings.

DETAILED DESCRIPTION

Figure 1:
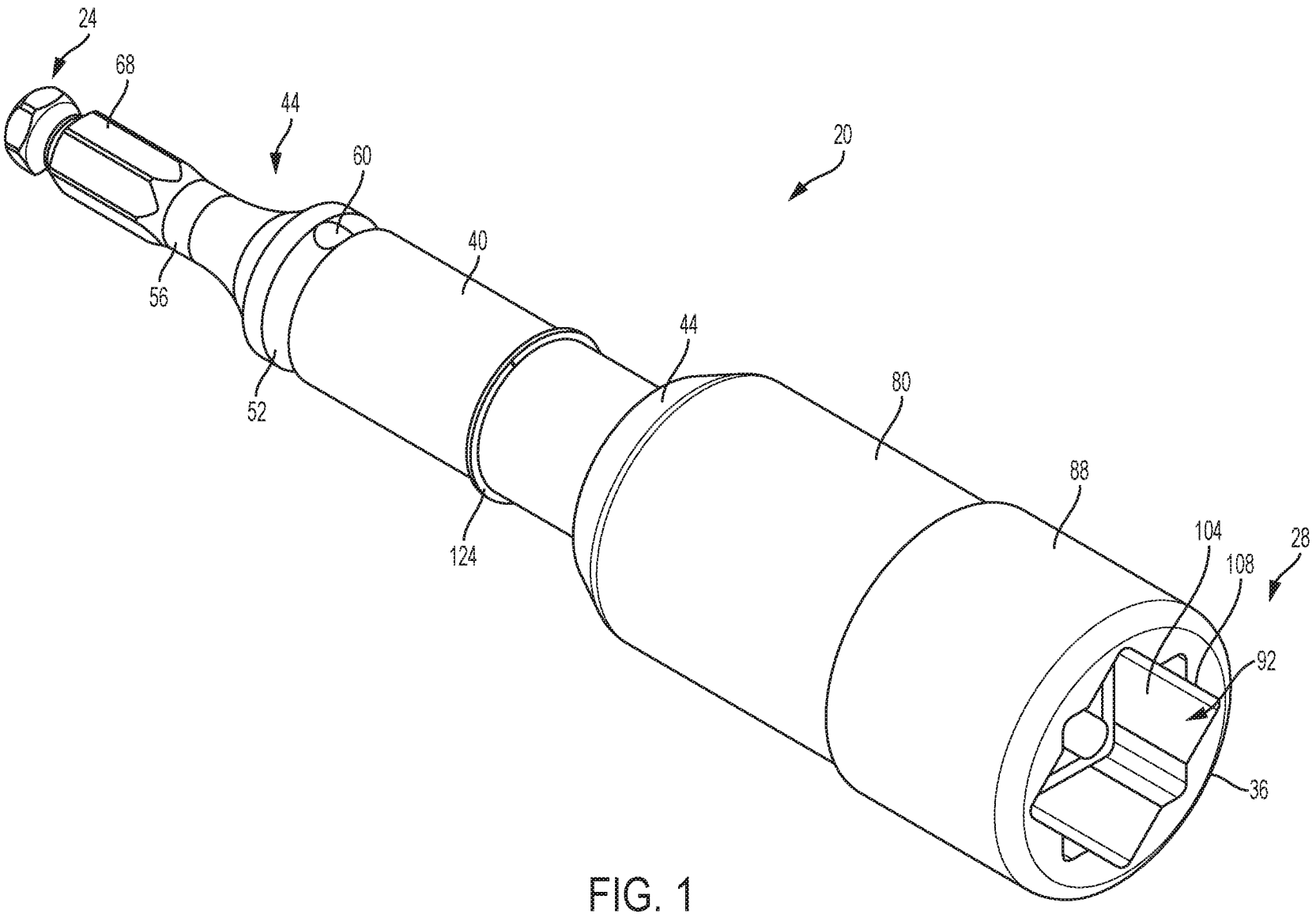
FIG. 1 is a perspective view of a driver.
Figure 2:
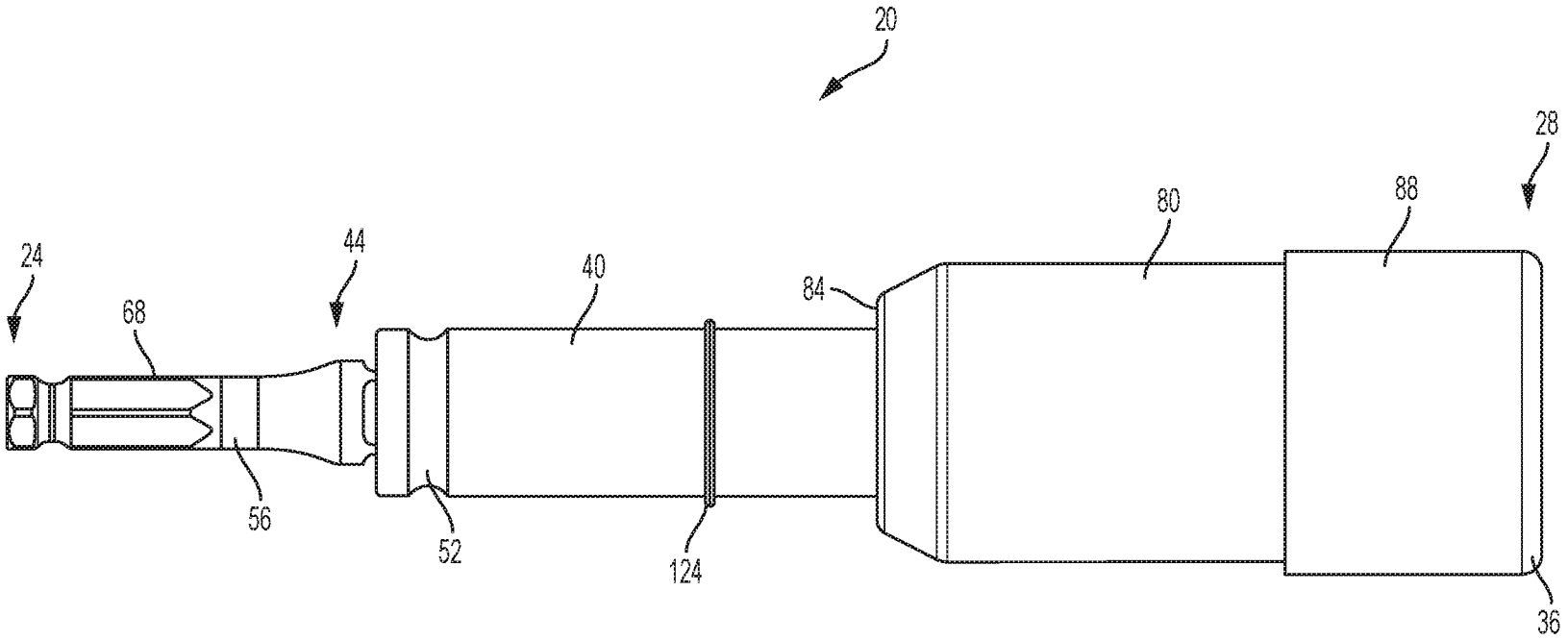
FIG. 2 is a first side view of the driver.
Figure 3:
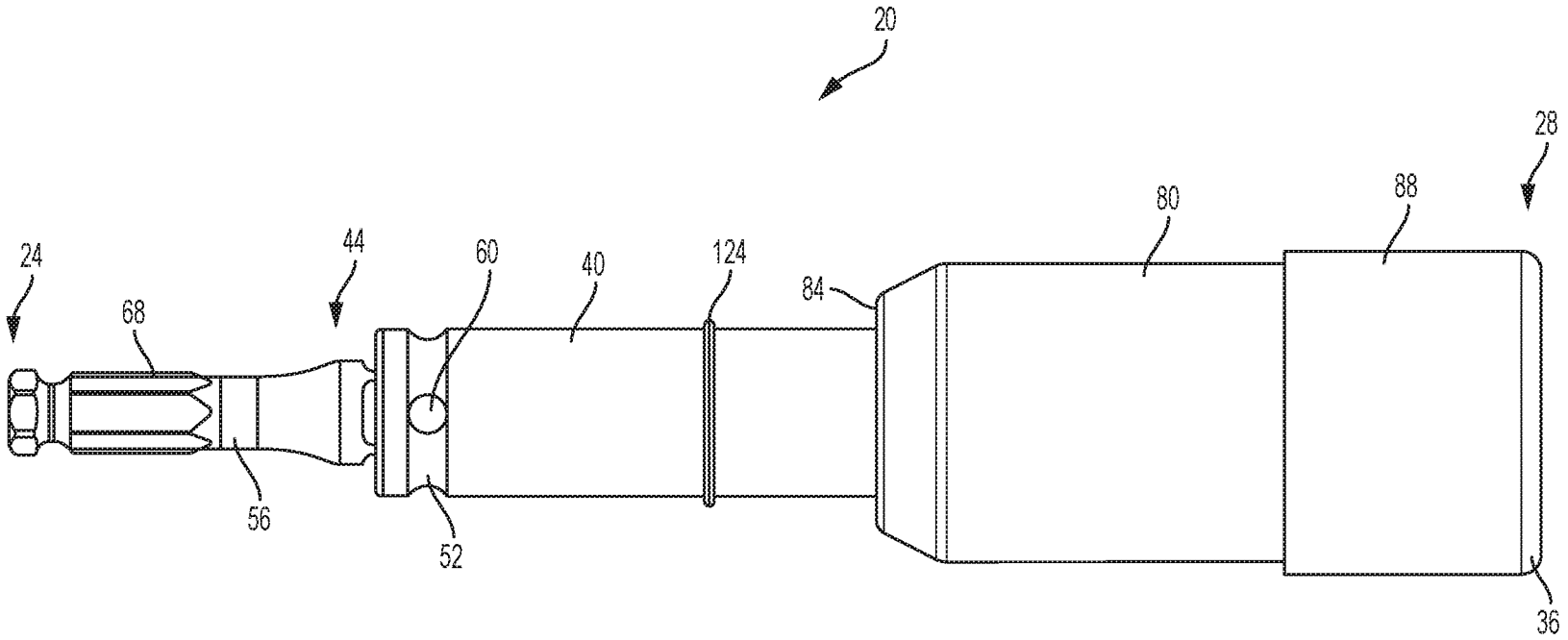
FIG. 3 is a second side view of the driver.
Figure 4:
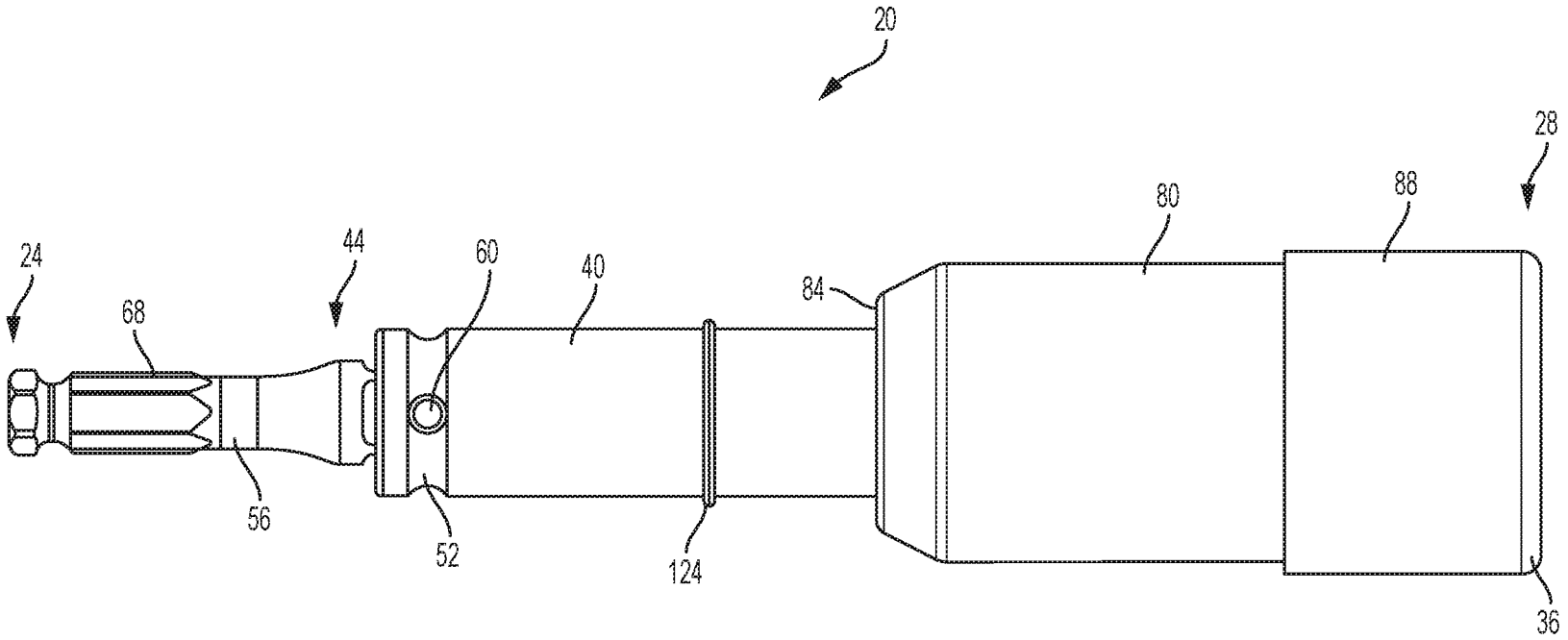
FIG. 4 is a third side view of the driver.
Figure 6:
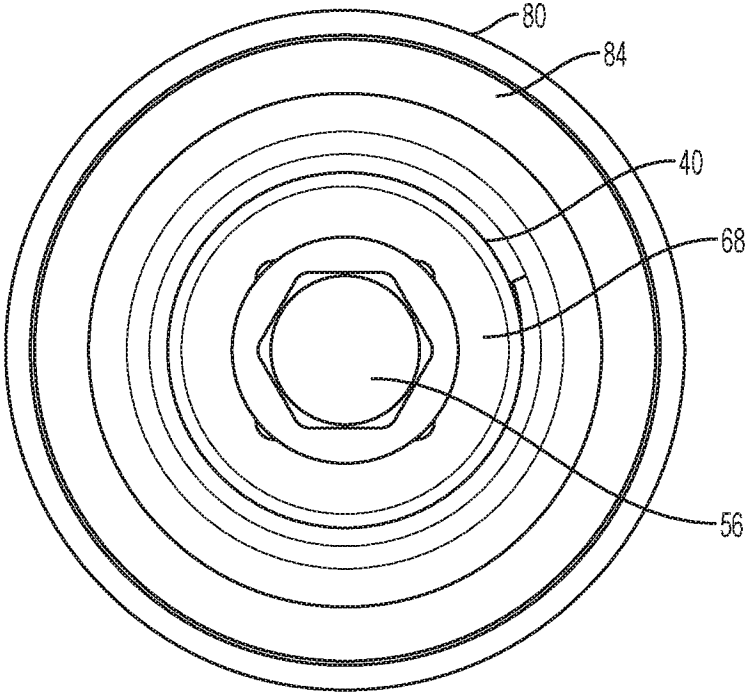
FIG. 6 is a rear view of the driver.
Figure 5:
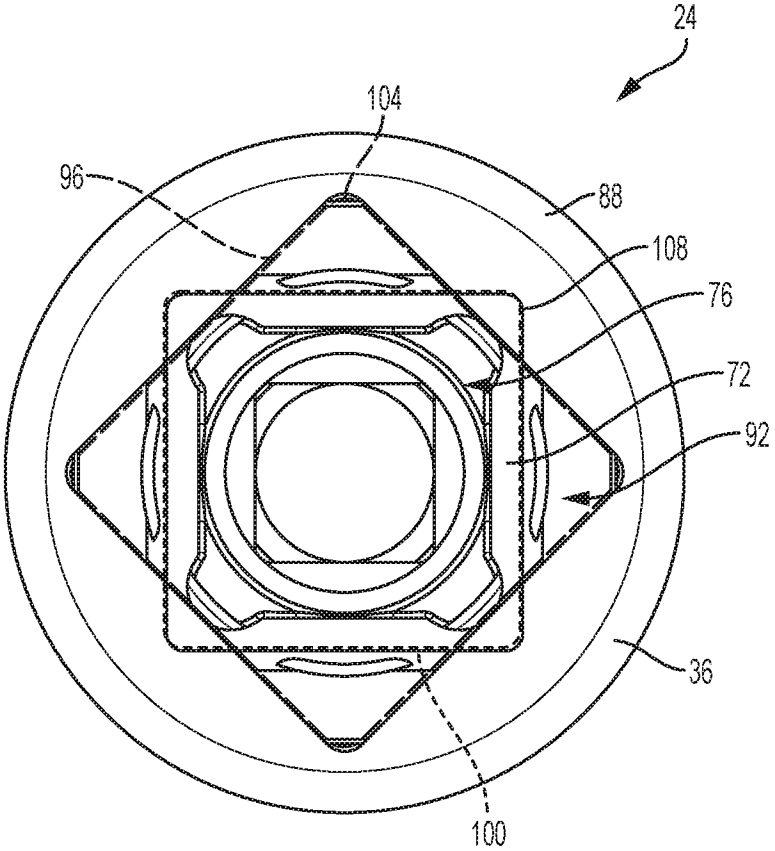
FIG. 5 is a front view of the driver.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

FIGS. 1-14 illustrate an accessory driver tool or driver 20 that is connectable to a tool (e.g., a power tool) at a first end 24 and operatively engages a workpiece (e.g., a fastener) at a second end 28. The second end 28 of the driver 20 includes a first fastener driving member 32 and a second fastener driving member 36 that are sized and shaped to engage multiple differently sized fasteners. As will be described in greater detail below, the driver 20 is operable between a retracted position, in which the first fastener driving member 32 is exposed to engage at least a first fastener, and an extended position, in which the second fastener driving member 36 is exposed to engage at least a second fastener.

With reference to FIGS. 1-7, the driver 20 includes a generally cylindrical main body 40 having a bit coupling mechanism 44 disposed on the first end 24 and the first fastener driving member 32 on the second end 28. The bit coupling mechanism 44 includes a bit coupling bore 48 (FIGS. 7 and 8) extending into an axial end of the main body 40 and a circumferential groove 52 disposed adjacent the first end 24. In the illustrated embodiment, the bit coupling bore 48 has a substantially square shaped cross section that receives, for example, a standard socket adapter 56. The bit coupling mechanism 44 further includes a pair of opposed bit retention detents 60 extending along a radial direction of the main body 40 from an inner sidewall of the bit coupling bore 48 and through the groove 52. In use, the bit retention detents 60 receive, for example, a biased member (e.g., a ball, pin, etc.) of the socket adapter 56 to retain the socket adapter 56 within the bit coupling bore 48. However, it should be noted that other bit coupling mechanisms 44 may be used in other embodiments. In addition, in some embodiments, the bit (i.e., the socket adapter 56) may be formed integrally with the main body 40.

Figure 7:
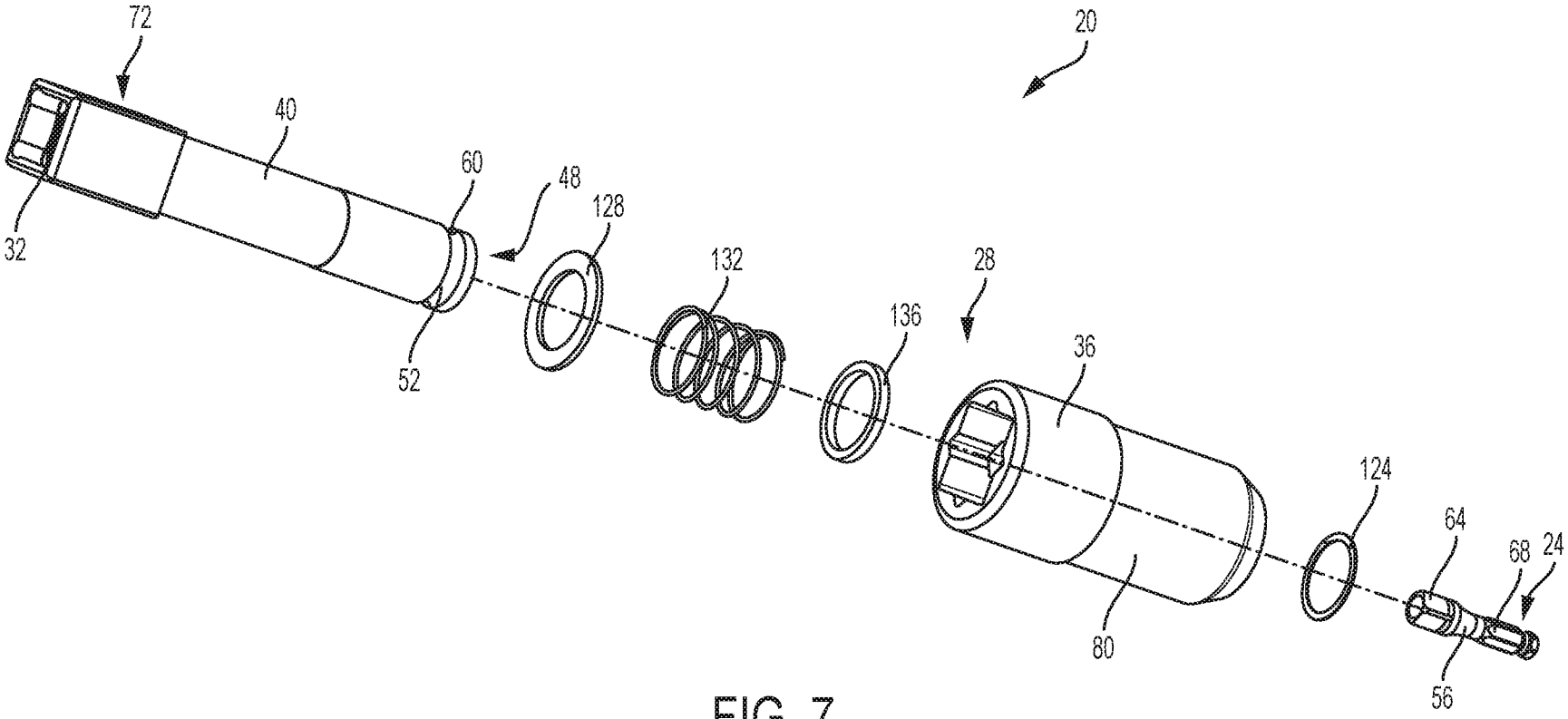
FIG. 7 is an exploded view of the driver.

With specific reference to FIG. 7, the socket adapter 56 includes a socket adapter end 64 engageable with the bit coupling mechanism 44 and a hexagonal shank 68 that may be operatively coupled to a conventional power tool chuck.

Figure 8:
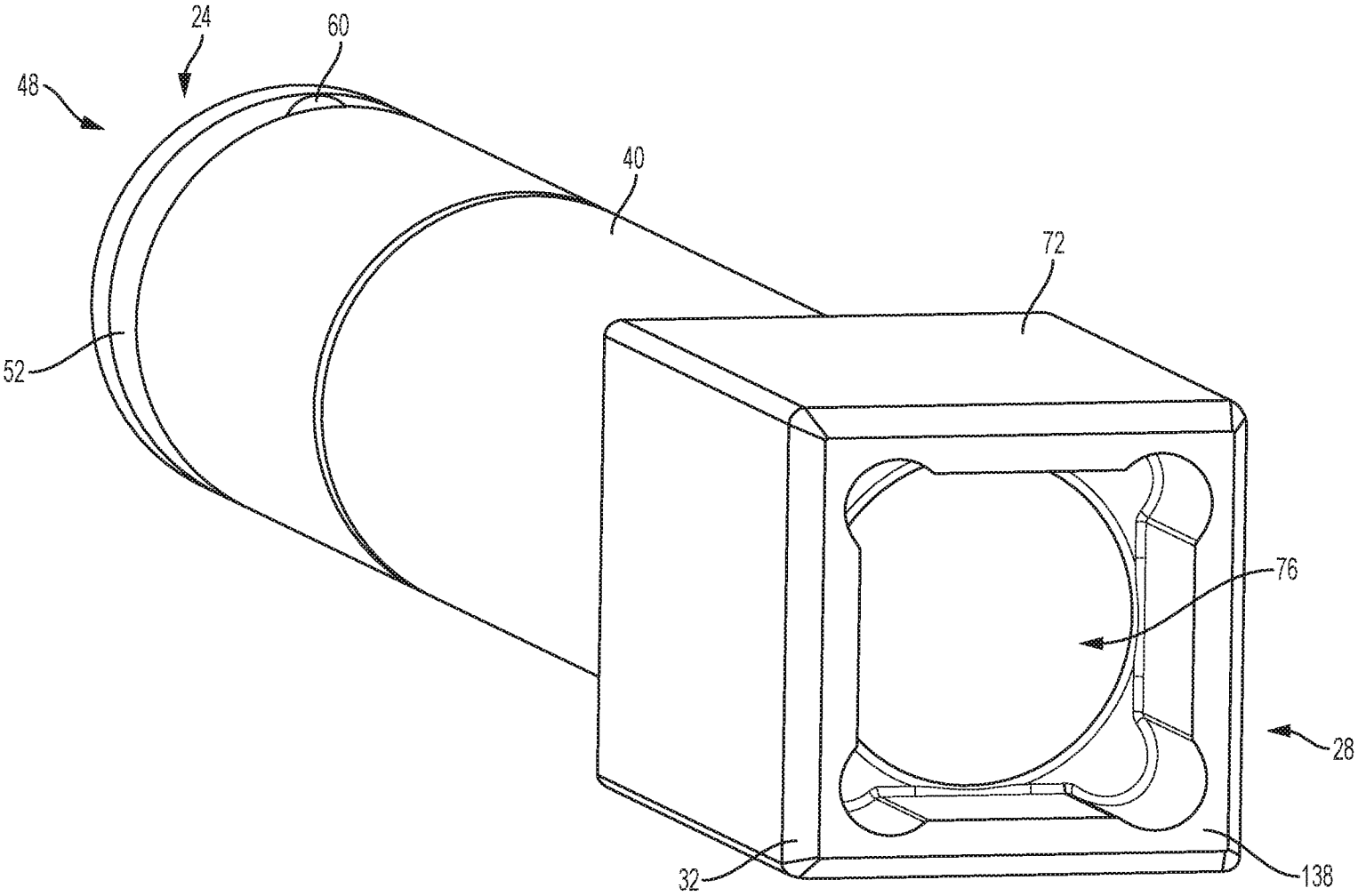
FIG. 8 is a perspective view of a first fastener driving member of the driver of FIG. 1.

With reference to FIG. 8, the first fastener driving member 32 is defined by a polygonal body 72 (e.g., a rectangular or square body) having a first fastener driving aperture 76 extending into the second end 28. The first fastener driving aperture 76 is sized and shaped to engage a first fastener having a first size. In the illustrated embodiment, the first fastener driving aperture 76 is a substantially square shaped aperture. The size and shape of the first fastener driving aperture 76 may be varied according to the type of fastener the driver 20 is configured to be used with.

With renewed reference to FIGS. 1-7, an axially displaceable sleeve 80 is disposed concentrically about the main body 40 proximate the second end 28. The sleeve 80 includes a tapered end terminating at an engagement surface 84 facing toward the first end 24, and the second fastener driving member 36 coupled to the second end 28. In the illustrated embodiment, the second fastener driving member 36 is coupled concentrically about the second end 28 of the sleeve 80 (e.g., via interference fit, welding, etc.). However, in other embodiments, the sleeve 80 and the second fastener driving member 36 are integrally formed.

Figure 9:
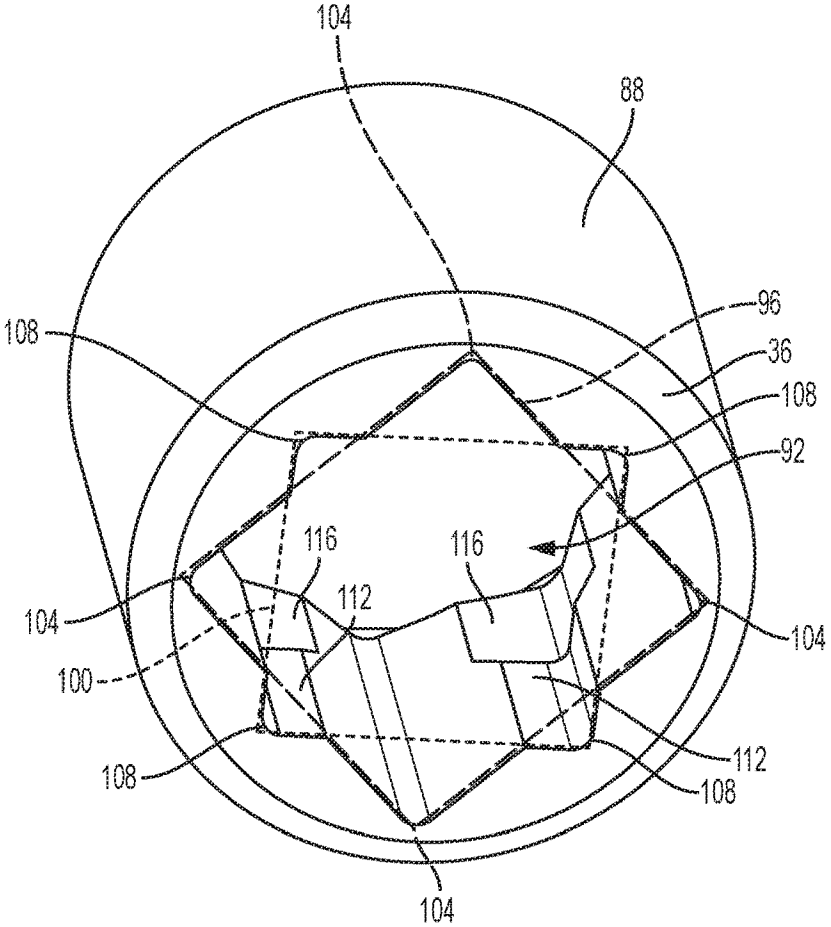
FIG. 9 is a front perspective view of a second fastener driving member of the driver of FIG. 1.

With reference to FIG. 9, the second fastener driving member 36 is defined by a cylindrical body 88 having a second fastener driving aperture 92 extending therethrough. The second fastener driving aperture 92 is sized and shaped to engage at least one second fastener having a second size that is larger than the first size. In the illustrated embodiment, the second fastener driving aperture 92 includes a first opening 96 and a second opening 100. The first opening 96 is a square opening defined by four first v-shaped slots or channels 104. The first opening 96 is configured to receive a fastener, and is also approximately the same size as the body of the first fastener driving member 32. The second opening 100 is a square opening rotationally offset (e.g., by 45 degrees) from the first opening 96. The second opening 100 is defined by four second v-shaped slots or channels 108, with the second opening 100 being smaller than the first opening 96. The second opening 100 is configured to receive a fastener sized smaller than the fastener received in the first opening 96. The size and shape of the second fastener driving aperture 92 (e.g., the first opening 96 and the second opening 100) may be varied according to the type of fastener the driver 20 is configured to be used with.

Figure 10:
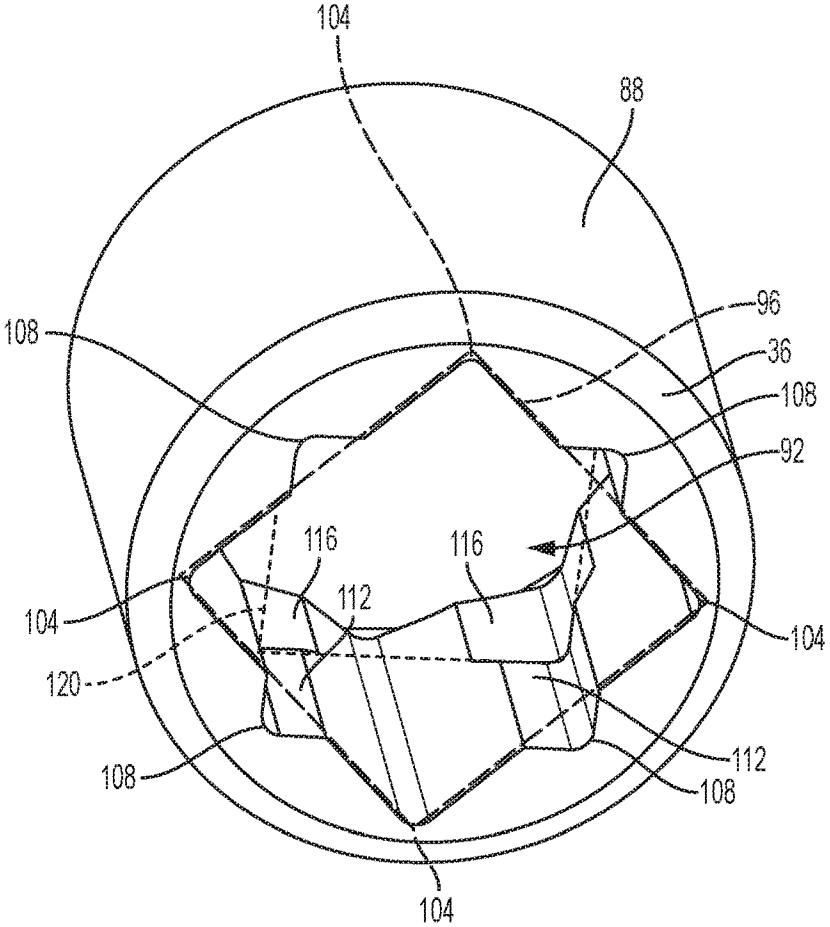
FIG. 10 is another front perspective view of the second fastener driving member of the driver of FIG. 1.
Figure 11:
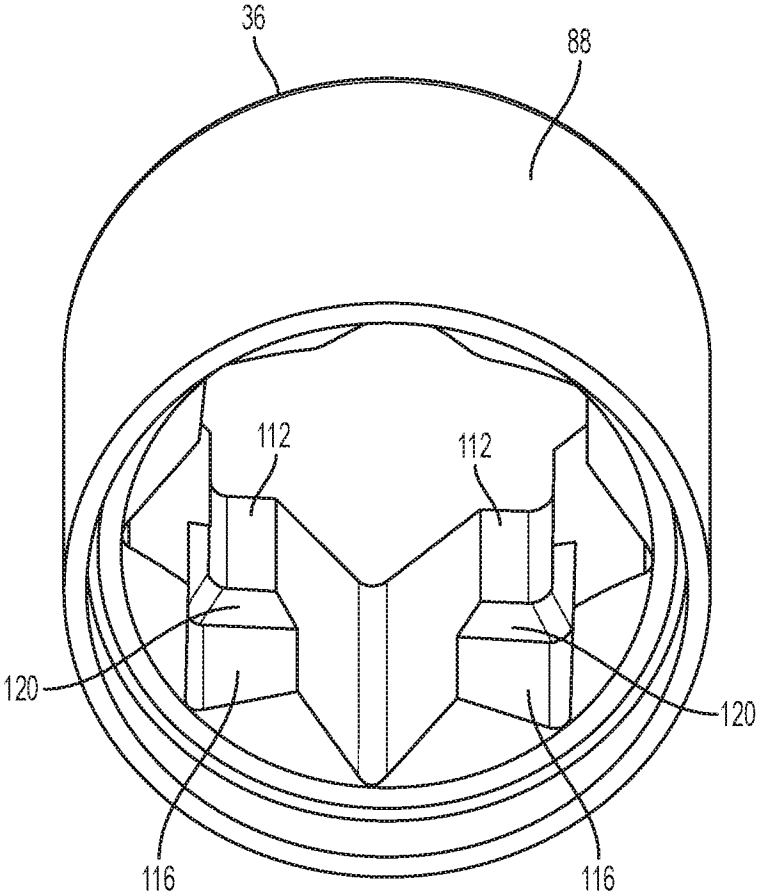
FIG. 11 is a rear perspective view of the second fastener driving member of the driver of FIG. 1.

With reference to FIGS. 10 and 11, the first slots 104 extend along the entirety of the second fastener driving aperture 92 such that the first opening 96 extends completely through the second fastener driving member 36. The second slots 108 each include a first portion 112 and a second portion 116. The first portion 112 is disposed on the second end 28 of the second fastener driving aperture 92 and is a fastener engaging portion such that each of the first portions 112 collectively defines the corners of the second opening 100. The second portion 116 of the second slots 108 is widened (e.g., to the size of the first opening 96 or the size of the body 72 of the first fastener driving member 32) creating a locking feature, such that a locking surface or shoulder 120 is defined between the first portion 112 and the second portion 116. The locking surface 120 faces toward the first end 24 and is engageable with the body of the first fastener driving member 32.

Figure 12:
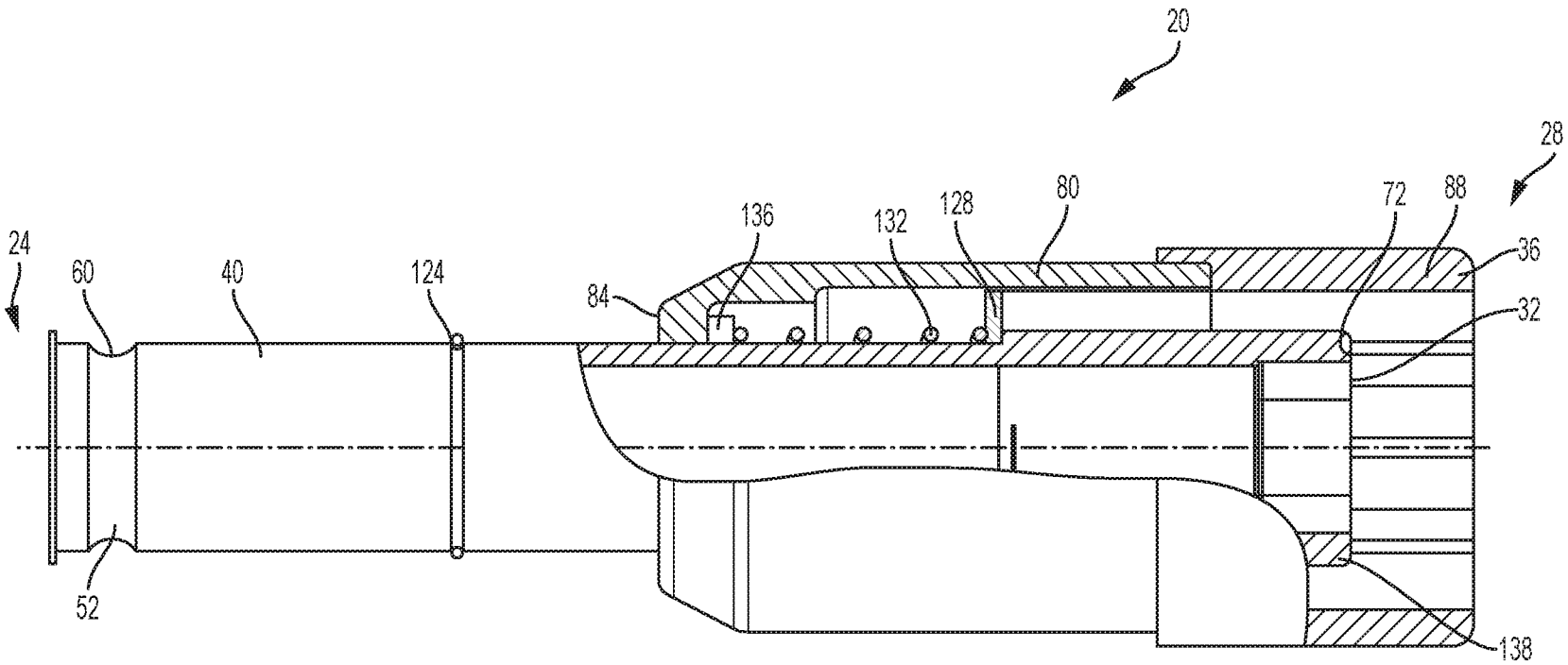
FIG. 12 is a partial cross-sectional view of the driver in an extended position.
Figure 13:
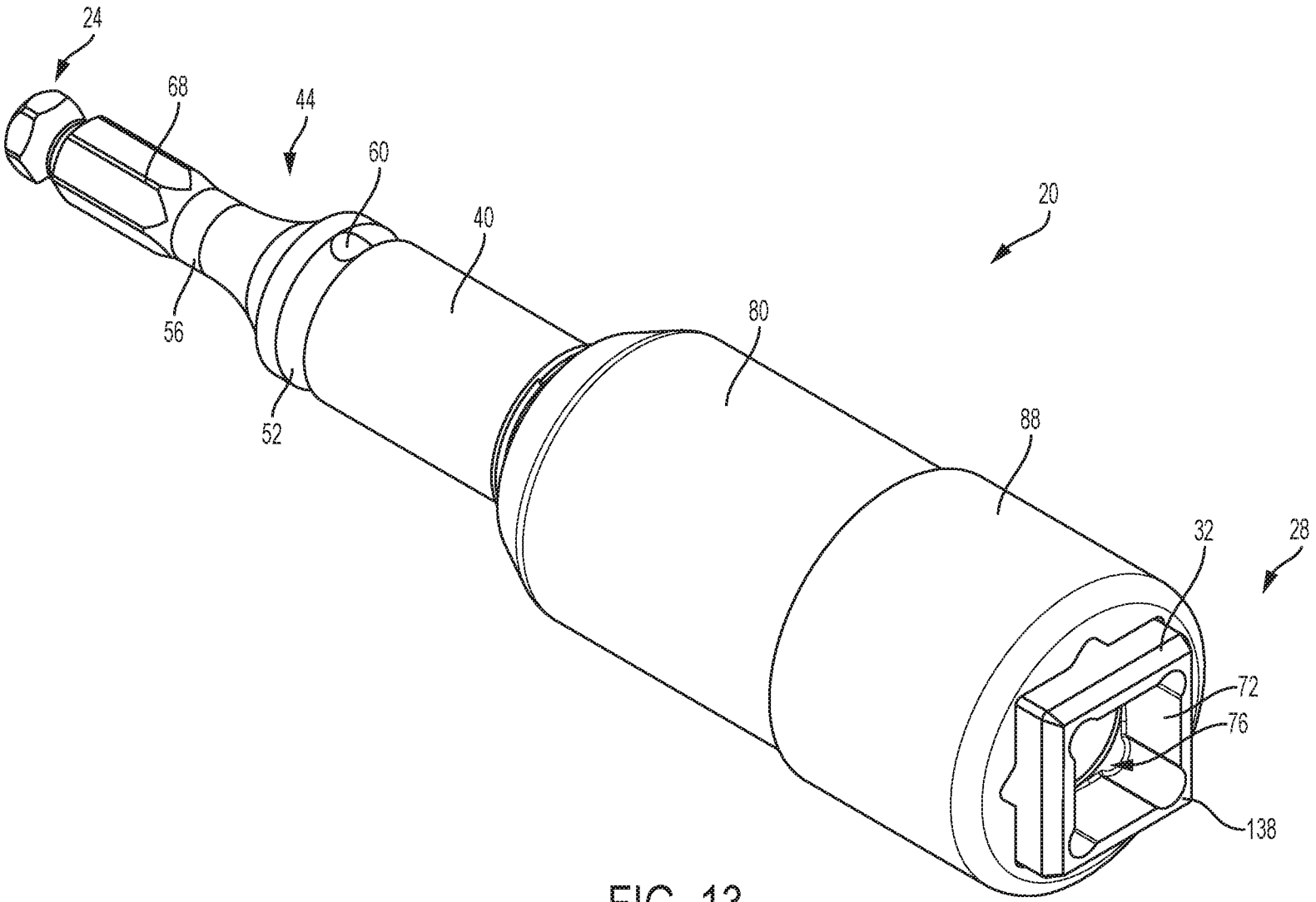
FIG. 13 is a perspective view of the driver of FIG. 1 in a retracted position.
Figure 14:
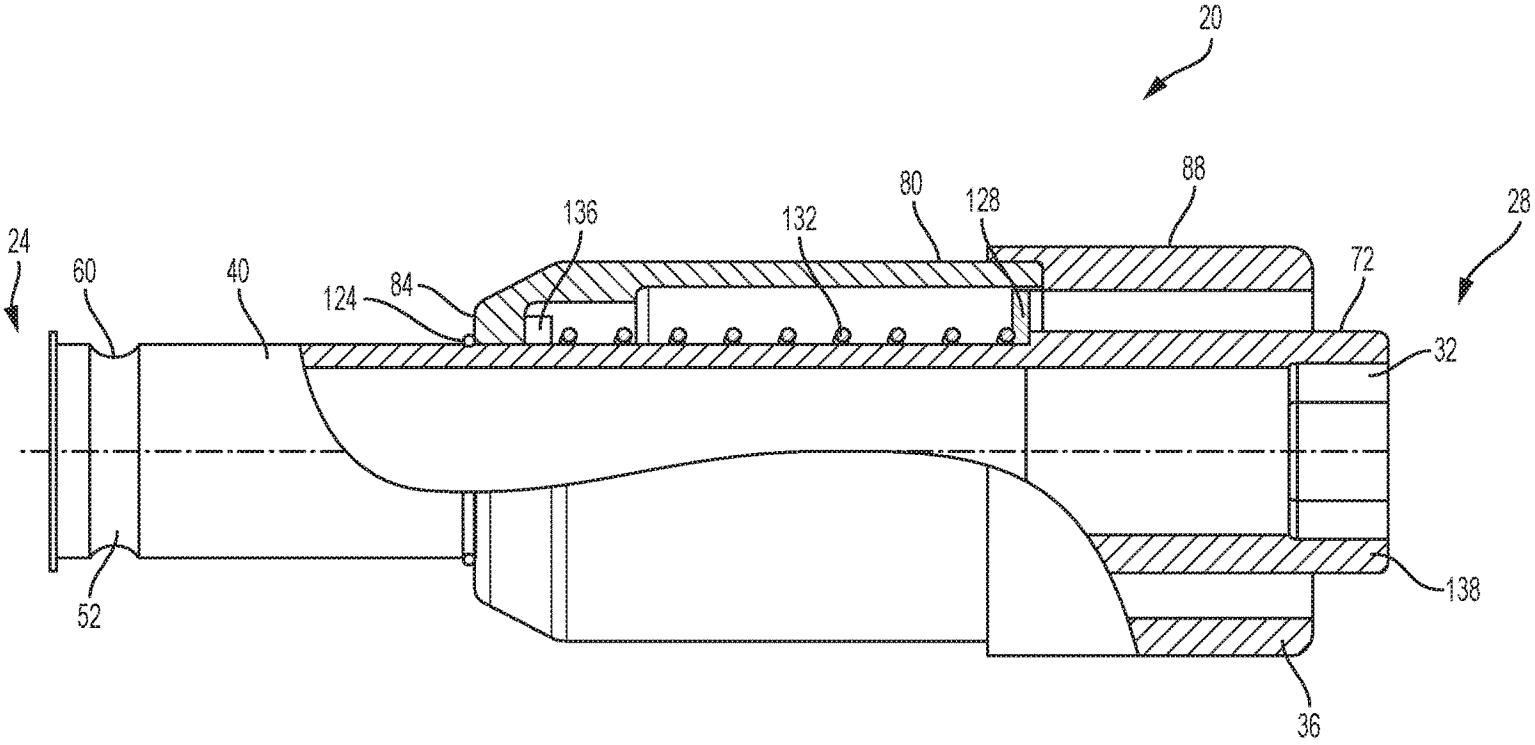
FIG. 14 is a partial cross-sectional view of the driver of FIG. 1 in the retracted position.

With reference to FIGS. 7 and 12, a stop member or retaining ring 124 is coupled to the main body 40 at a first axial position. In the illustrated embodiment, the stop member 124 includes a snap ring. A first thrust washer 128 is disposed about or coupled to the main body 40. In the illustrated embodiment, the first thrust washer 128 abuts a surface defined by the body 72 of the first fastener driving member 32 that faces the first end 24. A distance defined between the stop member 124 and the first thrust washer 128 generally represents a displaceable distance of the sleeve 80.

The driver 20 further includes a biasing member (e.g., a coil spring 132) disposed between the main body 40 and the sleeve 80. The spring 132 is disposed between the first thrust washer 128 and a second thrust washer 136 that abuts an interior surface of the sleeve 80. The sleeve 80, the surface of the first fastener driving member 32 facing the first end 24, and an interior portion of the second fastener driving member 36 thereby encapsulate the first thrust washer 128, the spring 132, and the second thrust washer 136, but not the stop member 124. The spring 132 applies a biasing force to the sleeve 80 via the second thrust washer 136 toward the first end 24 of the driver 20. In some embodiments, the second thrust washer 136 is formed integrally with the sleeve 80.

The driver 20 is movable between the retracted position (FIGS. 13-14) and the extended position (FIGS. 1-6 and 12). In the retracted position, the spring 132 urges the sleeve 80 and the second fastener driving member 36 toward the first end 24 such that the sleeve 80 is held in position via the engagement between the engagement surface 84 of the sleeve 80 and the stop member 124. In this position, the first fastener driving member 32 extends through the first opening 96 of the second fastener driving aperture 92 such that the first fastener driving member 32 is exposed for use with a first sized fastener.

In the extended position, the sleeve 80 is axially displaced toward the second end 28 relative to the retracted position such that the first fastener driving member 32 is retracted into the sleeve 80 through the first opening 96 of the second fastener driving aperture 92 and the second fastener driving member 36 is exposed to engage a second sized fastener. The locking surfaces 120 of the second fastener driving member 36 engage an end surface 138 of the first fastener driving member 32 to maintain the driver 20 in the extended position of the sleeve 80 against the bias of the spring 132.

To operate the driver 20 from the retracted position to the extended position, a user displaces the sleeve 80 toward the second end 28 against the bias of the spring 132 such that the first fastener driving member 32 is retracted through the first opening 96 of the second fastener driving member 36 into the interior of the sleeve 80. Once the sleeve 80 is displaced far enough for the first fastener driving member 32 to be received within the sleeve 80 such that the body 72 of the first fastener member does not engage the first slots 104, the user rotates the sleeve 80 (e.g., approximately 45 degrees in either direction) such that the body 72 is aligned with the second slots 108. More specifically, in this position, the body 72 is aligned with the second portion 116 of the second slots 108. The user then releases the sleeve 80 such that the spring 132 acts to displace the sleeve 80 toward the first end 24.

Displacement of the sleeve 80 is arrested by the engagement of the end surface 138 the body 72 and the locking surfaces 120 of the second slots 108 to axially and rotationally lock the sleeve 80 into the extended position. In this extended position, the second fastener driving member 36 is exposed for use.

To operate the driver 20 from the extended position to the retracted position, a user displaces the sleeve 80 toward the second end 28 against the bias of the spring 132 to disengage the end surface 138 of the body 72 and the locking surfaces 120 and to remove the body 72 from the second portion 116 of the second slots 108. Once this position is reached, the user further rotates the sleeve 80 (e.g., approximately 45 degrees in either direction) such that the body 72 is aligned with the first slots 104. The user then releases the sleeve 80 such that the spring 132 acts to displace the sleeve 80 toward the first end 24. Displacement of the sleeve 80 is arrested by the engagement of the engagement surface 84 of the sleeve 80 and the stop member 124. In this retracted position, the first fastener driving member 32 is exposed for use.

With renewed reference to FIG. 7, an exemplary method of assembling the driver 20 will be explained. In a first step, the second thrust washer 136 is inserted into the sleeve 80 through the second fastener driving aperture 92. In a second step, the spring 132 is inserted into the sleeve 80 through the second fastener driving aperture 92 until the spring 132 abuts the second thrust washer 136. In a third step, the first thrust washer 128 is rotated (e.g., 90 degrees) with respect to the orientation illustrated in FIG. 7 such that the first thrust washer 128 may be aligned with the first slots 104 of the first opening 96 to insert the first thrust washer 128 into the sleeve 80. Full insertion of the first thrust washer 128 into the sleeve 80 compresses the spring 132. In a fourth step, the first thrust washer 128 is rotated within the sleeve 80 to restore the orientation shown in FIG. 7 such that the first thrust washer 128, the spring 132, and the second thrust washer 136 are retained within the sleeve. In a fifth step, this assembly, including the sleeve 80, the first thrust washer 128, the spring 132, and the second thrust washer 136, is advanced along the main body 40 until the first thrust washer 128 engages the body 72 of the first fastener driving member 32. In a sixth step, the stop member 124 is coupled to the main body 40 thereby retaining each of the first thrust washer 128, the spring 132, the second thrust washer 136, and the sleeve 80 in position on the main body 40.

Although the invention has been described in detail with reference to certain preferred embodiments, variations and modifications exist within the scope and spirit of one or more independent aspects of the invention as described.

What is claimed is:

1. An accessory driver tool connectable to a power tool, the accessory driver tool comprising:

a main body having a first end, a second end, a tool coupling mechanism at the first end, and a first fastener driving member disposed at the second end; and a sleeve disposed concentrically about the main body, the sleeve having a second fastener driving member disposed adjacent the second end of the main body, the sleeve being axially displaceable along the main body between a retracted position, in which the first fastener driving member is exposed to engage a first fastener, and an extended position, in which the second fastener driving member is exposed to engage a second fastener, the sleeve and the second fastener driving member fixed relative to the first fastener driving member while in the extended position, the sleeve and the second fastener driving member being rotatable relative to the first fastener driving member while displaced beyond the extended position.

2. The accessory driver tool of claim 1, further comprising a spring coupled between the sleeve and the main body to bias the sleeve toward the retracted position.

3. The accessory driver tool of claim 2, wherein the main body includes an end surface formed at the second end, wherein the sleeve further includes a locking feature formed on an inner surface of the sleeve, and wherein the locking feature engages the end surface to retain the sleeve in the extended position.

4. The accessory driver tool of claim 3, wherein rotation of the sleeve while in the extended position engages the locking feature with the end surface of the main body to inhibit the spring from biasing the sleeve toward the retracted position.

5. The accessory driver tool of claim 4, wherein further rotation of the sleeve while in the extended position disengages the locking feature from the end surface of the main body, permitting the spring to bias the sleeve toward the retracted position.

6. The accessory driver tool of claim 4, wherein the second fastener driving member includes an opening configured to receive the second fastener, and wherein the locking feature includes an inwardly-extending shoulder defined by the opening.

7. The accessory driver tool of claim 6, wherein the opening includes a first portion having a first outer dimension and a second portion having a second outer dimension that is larger than the first outer dimension, wherein the first portion of the opening is configured to receive the second fastener, and wherein the inwardly-extending shoulder is defined between the first portion and the second portion.

8. The accessory driver tool of claim 7, wherein the opening is a first opening, wherein the second fastener driving member includes a second opening that overlaps and is offset from the first opening, and wherein the second opening is configured to receive a third fastener that is different than the second fastener.

9. The accessory driver tool of claim 2, further comprising a first thrust washer abutting the first fastener driving member and a second thrust washer abutting an interior surface of the sleeve, and wherein the spring is positioned between the first thrust washer and the second thrust washer and applies a biasing force to the sleeve via the second thrust washer.

10. The accessory driver tool of claim 1, further comprising a stop member coupled to the main body, wherein the sleeve engages the stop member while in the retracted position.

11. A method for operating an accessory driver tool, the accessory driver tool including a main body having a first end, a second end, and a tool coupling mechanism at the first end and a first fastener driving member disposed at the second end, and a sleeve disposed concentrically about the main body, the sleeve having a second fastener driving member disposed adjacent the second end, the method comprising:

engaging a first fastener with the first fastener driving member of the main body while the sleeve is in a retracted position relative to the main body;

axially displacing the sleeve along the main body from the retracted position toward the second end of the main body and at least partially beyond the first fastener driving member;

rotating the sleeve and the second fastener driving member relative to the first fastener driving member to seat the first fastener member within the second fastener driving member in an extended position, wherein the sleeve and the second fastener driving member are fixed relative to the first fastener driving member while in the extended position; and engaging a second fastener with the second fastener driving member of the sleeve while the sleeve is in the extended position.

12. The method of claim 11, wherein the accessory driver tool includes a spring coupled between the main body and the sleeve, and further comprising biasing the sleeve toward the retracted position by the spring.

13. The method of claim 11, wherein the main body includes an end surface formed at the second end, wherein the sleeve includes a locking feature, wherein rotating the sleeve relative to the main body includes engaging the end surface with the locking feature to secure the sleeve in the extended position against the bias of the spring.

14. The method of claim 13, further comprising further rotating the sleeve to disengage the locking feature from the end surface, and axially displacing the sleeve along the main body from the extended position to the retracted position after the locking feature disengages the end surface.

15. An accessory driver tool connectable to a power tool, the accessory driver tool comprising:

a main body having a first end, a second end, a tool coupling mechanism at the first end, and a first fastener driving member disposed at the second end, the second end of the main body defining an end surface;

a sleeve disposed concentrically about the main body, the sleeve having a second fastener driving member disposed adjacent the second end, the sleeve including a locking feature formed on an inner surface of the sleeve; and a spring coupled between the sleeve and the main body to bias the sleeve toward a retracted position, in which the first fastener driving member is exposed to engage a first fastener;

wherein the sleeve is axially displaceable along the main body against a bias of the spring to an extended position, in which the second fastener driving member is exposed to engage a first fastener, wherein the locking feature of the sleeve engages the end surface of the main body to secure the sleeve in the extended position against the bias of the spring.

16. The accessory tool of claim 15, wherein the locking feature engages the end surface of the main body through rotation of the sleeve when the sleeve is in the extended position.

17. The accessory tool of claim 16, wherein the locking feature is disengaged from the end surface through further rotation of the sleeve, permitting the spring to bias the sleeve toward a retracted position, in which the first fastener driving member is exposed to engage a second fastener.

18. The accessory driver tool of claim 15, wherein the second fastener driving member includes an opening configured to receive the second fastener, and wherein the locking feature includes an inwardly-extending shoulder defined by the opening.

19. The accessory driver tool of claim 18, wherein the opening includes a first portion having a first outer dimension and a second portion having a second outer dimension that is larger than the first outer dimension, wherein the first portion of the opening is configured to receive the second fastener, and wherein the inwardly-extending shoulder is defined between the first portion and the second portion.

20. The accessory driver tool of claim 19, wherein the opening is a first opening, wherein the second fastener driving member includes a second opening that overlaps and is offset from the first opening, and wherein the second opening is configured to receive a third fastener that is different than the second fastener.

* * * * *